United States Patent [19]

Stadig

[11] Patent Number: 4,953,810

[45] Date of Patent: Sep. 4, 1990

[54] HOLDER AND DISPENSER FOR A COILED ARTICLE

[76] Inventor: Allen L. Stadig, R.F.D. #1, Box 1103, Soldier Pond, Me. 04781

[21] Appl. No.: 476,688

[22] Filed: Feb. 8, 1990

[51] Int. Cl.[5] ..... B65H 49/28

[52] U.S. Cl. ..... 242/129; 242/85; 242/129.8; 242/141

[58] Field of Search ..... 242/129, 129.8, 128, 242/129.5, 130, 130.4, 134, 139, 140, 141, 156, 156.1, 55.2, 55.54, 85, 86, 105, 54 R

[56] References Cited

U.S. PATENT DOCUMENTS

| | | | |
|---|---|---|---|
| 232,168 | 9/1880 | Beardslee | 242/129 X |
| 2,281,849 | 5/1942 | McCoppin . | |
| 2,488,641 | 11/1949 | Seawright . | |
| 2,491,585 | 12/1949 | Sammons | 242/141 |
| 2,619,396 | 11/1952 | Fires . | |
| 3,951,079 | 4/1976 | Tolleson . | |
| 4,089,486 | 5/1978 | Carter | 242/129 |
| 4,184,647 | 1/1980 | Rourke | 242/129.8 |
| 4,334,482 | 6/1982 | Boldue . | |
| 4,471,921 | 9/1984 | Corbin | 242/129 |
| 4,667,897 | 5/1987 | Burrow et al. | 242/129 |
| 4,826,100 | 5/1989 | Belliveau | 242/129 |

*Primary Examiner*—Stanley N. Gilreath
*Attorney, Agent, or Firm*—Donald J. Breh

[57] ABSTRACT

A holder and dispenser for a coiled article including a turn-table having a co-axially extending post and a plate mounted for slidable movement over the post. The coiled article is positionable on the turntable with the plate on a side of the coiled article opposite to the turntable side. A combination article guide and turntable brake is provided on the plate and includes an aperture through which the coiled article is pulled during dispensing of the article.

11 Claims, 1 Drawing Sheet

HOLDER AND DISPENSER FOR A COILED ARTICLE

BACKGROUND OF THE INVENTION

This invention relates to holders and in particular to a holder for holding coiled articles such as a coil of wire. In still greater particularity, the invention relates to a coiled article holder especially adapted for assisting in dispensing of the article from the coil as needed.

Devices for holding and storing coiled articles such as for example wire or hose exist and range from horizontally mounted pegs and platforms over which the coiled article is placed to boxes or cartons having a centrally located aperture from which the article is withdrawn. These devices either do not provide for any dispensing assist or are not reuseable such as in the case of a cardboard or paper board shipping carton typically used to ship and dispense electrical wire products.

Further, present reel type holders and dispensers such as those typically used to hold and dispense hoses are limited to use with only highly flexible articles such as hoses and are not easily transported and cannot easily dispense stiffer articles such as electrical wire. To the contrary, most such reel type holders are intended either to be permanently mounted or are so large that their portability is restricted.

SUMMARY OF THE INVENTION

It is accordingly an object of the present invention to provide for a holder for coiled articles which is highly portable, can accommodate a variety of different types of coiled articles and which assists in uncoiling and dispensing of the coiled article in desired lengths.

According to preferred embodiment of the invention, there is provided a rotatable turntable having a co-axially extending post over which the coiled article is placed. A plate is slidably mounted on the post and is positionable on a side of the coiled article opposite to the turntable side of the article.

According to an important feature of the invention, means are provided for guiding the removal of the coiled article as it is pulled generally tangentially from the body of the coil.

According to another important aspect of the invention, the means for guiding further provides for braking the rotation of the turntable upon cessation of uncoiling.

According to the invention, the means for guiding and braking includes an aperture associated with the slidable plate through which the coiled article is threaded and pulled.

According to one aspect of the invention, the aperture is a closed loop depending from the plate.

According to another aspect of the invention, the aperture is provided in a member extending from the plate in a direction generally toward the turntable.

According to a still further important feature of the invention, the turntable is mounted on a stationary base and the free end of the post is provided with a handle for facilitating transport of the device.

BRIEF DESCRIPTION OF THE DRAWINGS

The invention will be better understood after reading the following Detailed Description of the Preferred Embodiment in conjunction with the drawings of which.

DETAILED DESCRIPTION OF THE PREFERRED EMBODIMENT

Figure 1:
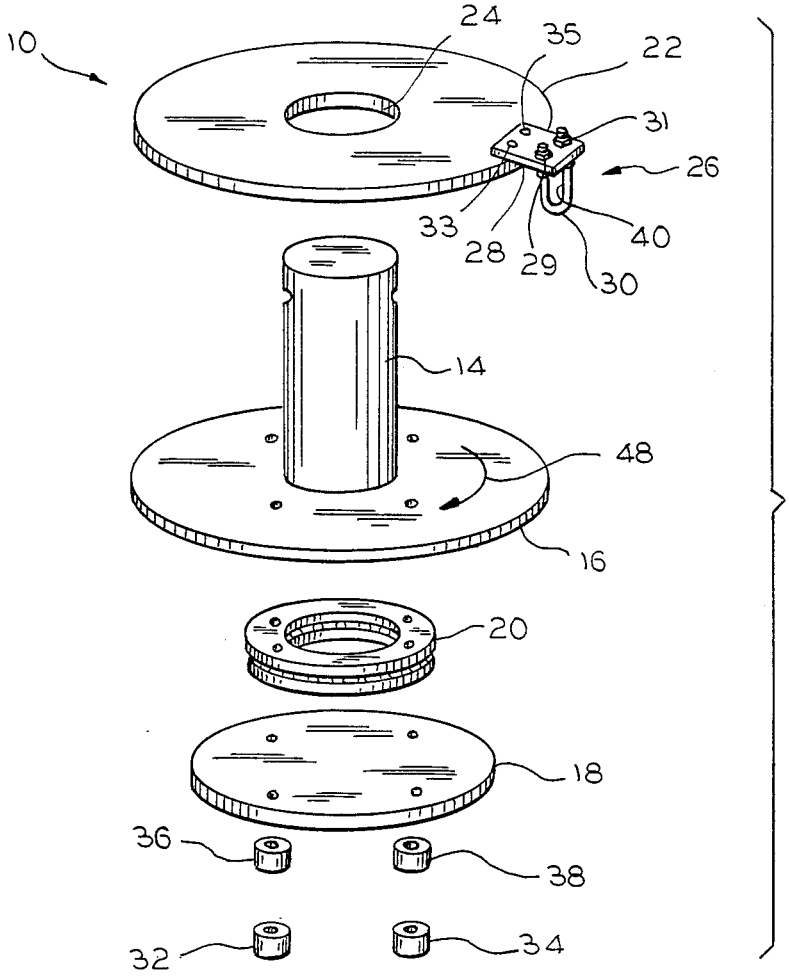
FIG. 1 is an exploded view of a preferred embodiment of a holder and dispenser according to the invention showing details of construction and assembly.

Shown in FIG. 1 is a holder 10 for holding and dispensing a coiled article 12 such as a coil of wire, cable or hose. Any generally flexible, coilable article can be used with the device 10 and the invention is not be considered limited to the specific coiled wire article shown.

The holder 10 includes a turntable which in the embodiment shown includes a rotable plate or platform 16 having a co-axially extending post 14. In the preferred embodiment shown, the post 14 is mounted to a rotating plate or platform 16 which is in turn mounted to the base 18 by way of a bearing assembly 20 in well known manner. Slidably mounted on the post 14 is a second, upper, plate 22 which is free to rotate around the post 14.

Figure 2:
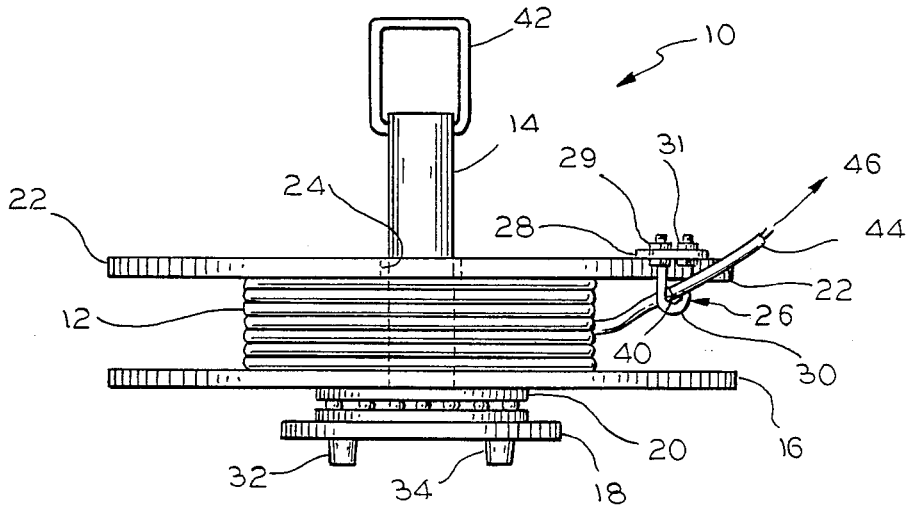
FIG. 2 is a side view of the assembled holder according to FIG. 1 showing further details of construction and operation.

According to a very important feature of the invention, there is provided a combination article guide and turntable brake 26 affixed to the upper plate 22 at its outer peripherial edge or boundry as shown in the drawings. The guide and brake member 26 comprises an aperture 40 associated with the plate 22 through which the article portion 44 is threaded and pulled during uncoiling of the article as described below. In the embodiment shown, the aperture 40 is formed by a depending member in the form of a depending U-bolt 30 which is secured by a pair of fasteners 29, 31 to a radially protruding plate 28 which is secured to the upper plate by way of a pair of fasteners 33, 35. The U-bolt depends downwardly out of the plane of the plate 22 in a direction generally toward the plane of the turntable and opens in a direction to allow passage of the article through the aperture as it is withdrawn generally tangentially from the coil 12 in the general direction indicated by the arrow 46 in FIG. 2. It can be appreciated that other aperture structures associated with the upper plate 22 can be devised by those skilled in the art and invention is not be considered limited to the protruding plate and U-bolt design shown.

Preferrably, the base 18 is provided with supports such as pads or bumpers 32, 34, 36, 38 and the free end of the post is provided with a handle 42 for facilitating transport of the device.

In use, the upper plate 22 is removed from the post 14 and the coil article 12 is placed on the support surface of the turntable 16 surrounding the post 14. The upper plate 22 is repositioned on the post 14 and the free end 44 of the coiled article is threaded through the aperture of the guide and brake member 26. In this state, the coiled article is securely held for storage and transport to different locations as desired without the article becoming uncoiled and otherwise entangled.

When it is desired to dispense a length of the coiled article, the free end of the article is pulled in the general direction of the arrow 46 so as to withdraw the article generally tangentially from the coil body and causing the turntable 16 to rotate in the direction of the arrow 48 in FIG. 1. The upper plate remains generally rotationally stationary and the guide loop or aperture member 26 guides and maintains the general tangential direction of dispensing of the article. When dispensing is ceased by stopping of the pulling of the article, the rotation of the turntable is braked due to the reaction force of the stationary top plate and associated loop as the loop is engaged by the article under the inertia of the rotating coil and turntable. As the article is dispensed and the coil height is reduced, the top plate progressively lowers toward the turntable always maintaining the guide and brake member in the proper position for dispensing of the article and braking of the turntable to prevent undesired backlash.

Having described the preferred embodiment of the invention, those skilled in the art having the benefit of that description and the accompanying drawings, can readily devise other embodiments and modifications and such other embodiments and modifications are accordingly to be within the scope of the appended claims.

What is claimed is:

1. A device for holding and dispensing a coiled article comprising:

a rotatable turntable having a support surface;

a post extending co-axially from said turntable;

a plate mounted co-axially on said post parallel to said support surface of said turntable for slidable movement toward and away from said turntable; and means associated with said plate for guiding said coiled article during dispensing and for braking the rotation of said turntable upon cessation of said dispensing.

2. The device as defined in claim 1 wherein said means for guiding said coiled article and for braking the rotation of said turntable comprises a loop associated with said plate adapted to have said article pass therethrough as said article is pulled generally tangentially from said coil.

3. The device as defined in claim 2 wherein said loop is located proximate an outer peripherial edge of said plate and extends in a direction toward said turntable.

4. The device as defined in claim 1 further including a base, said turntable mounted to said base.

5. A device for holding and for uncoiling a coiled article by pulling said article from said coil in a direction generally tangential to said coil, comprising:

a rotatable turntable having a support surface for supporting said coiled article on one side of the coil;

a post extending co-axially from said turntable, said coiled article positionable to encircled said post;

a plate mounted co-axially on said post for slidable movement toward and away from said turntable, said plate being parallel to said support surface;

said plate including aperture means associated with said plate adapted to have said article pass therethrough as it is tangentiallly pulled from said coil.

6. The device as defined in claim 5 wherein said aperture means is located proximate an outer peripherial edge of said plate.

7. The device as defined in claim 6 wherein said aperture means comprises a member extending from said plate in a direction generally toward said turntable, said member including an opening.

8. The device as defined in claim 7 including a stationary base, said turntable mounted to said stationary base.

9. A device for holding and dispensing a coiled article comprising:

a base;

a bearing mounted to said base;

a first plate mounted to said bearing, said first plate being rotatable relative to said base;

a post mounted to said first plate;

a second plate mounted co-axially on said post for slidable movement relative to said first plate, said second plate including a protruberance extending out of the plane of the second disc toward the plane of the first disc, said protruberance including an aperture.

10. The device as defined in claim 9 wherein said protruberance includes a depending member on said second plate proximate the peripherial edge of said second plate.

11. The device as defined in claim 9 further including a handle on a free end of said post.

* * * * *